United States Patent [19]

Boucherie

[11] 4,218,096

[45] Aug. 19, 1980

[54] DEVICE FOR HANDLING BRUSH BODIES MADE OF FLEXIBLE MATERIAL

[75] Inventor: Leonel P. Boucherie, Rumbeke, Belgium

[73] Assignee: Firma G. B. Boucherie, naamloze rennootschap, Izegem, Belgium

[21] Appl. No.: 968,735

[22] Filed: Dec. 12, 1978

[30] Foreign Application Priority Data

Apr. 27, 1978 [BE] Belgium ..... 56922

[51] Int. Cl.[2] ..... A46D 3/06

[52] U.S. Cl. ..... 300/3; 300/10

[58] Field of Search ..... 300/2, 3, 8, 9, 10, 300/11; 221/268; 414/131

[56] References Cited

U.S. PATENT DOCUMENTS

| | | | |
|---|---|---|---|
| 2,851,308 | 9/1958 | Karle et al. | 300/3 X |
| 3,355,216 | 11/1967 | Zahoransky | 300/3 |
| 3,640,582 | 2/1972 | Zahoransky | 300/3 |
| 3,858,941 | 1/1975 | Boucherie | 300/3 |

*Primary Examiner*—Howard N. Goldberg

*Attorney, Agent, or Firm*—Bacon & Thomas

[57] ABSTRACT

Device for handling brush bodies made of flexible material, characterized by the fact that it mainly consists of the combination of means for liberating brush bodies one at a time, means which punch holes in this brush bodies and means which maintain the brush body in the correct location during the punching of aforesaid holes; and means which maintain the brush body in the correct location during the filling thereof with fibres.

8 Claims, 11 Drawing Figures

DEVICE FOR HANDLING BRUSH BODIES MADE OF FLEXIBLE MATERIAL

This invention pertains to a device for handling brush bodies made of flexible material, more particularly brush bodies of rubber.

More particularly still, the device according to the invention pertains to means which permit such flexible brush bodies, which may or may not be precut, to be moved up to a brush holder opposite a punching device which punches the required holes in the brush body, one at a time, in synchronism with the filling tools, or else to be moved up to a matrix which makes provisions for the required holes to be punched, after which this brush body is further moved into an actual brush holder which permits the planting of fibres in this flexible brush body, and respectively the fixing thereof, whereby, although these devices can be used as such, they shall be used for a special application in a so-called drum machine.

This device mainly consists for this purpose of the combination of means for liberating brush bodies one at a time; means which punch holes in the brush body and means which maintain the brush body in the correct position during the filling thereof with fibres.

In order to show the characteristics of the invention more clearly, a few preferred forms of embodiment will be described hereinafter, as example and without the slightest restrictive intent, with reference to the appended drawings in which.

Figure 1:
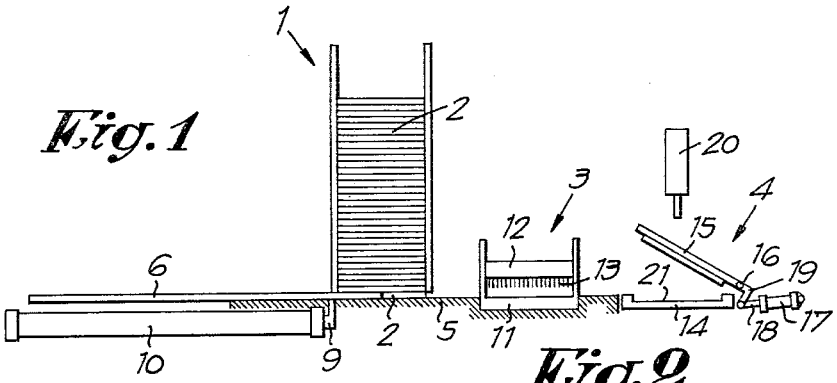
FIG. 1 shows a front view of a device according to the invention.

In the form of embodiment as illustrated in FIGS. 1 to 4, the device according to the invention mainly consists of a magazine 1 in which flexible brush bodies 2 can be stored; a matrix 3 which provides that holes are punched in the brush bodies 2 at the correct locations, and a brush holder which can appropriately receive and maintain the brush bodies provided with holes in order to permit the filling of the latter with fibres.

In this case, eliptically shaped brush bodies are being handled, so that the shapes of the magazine 1, of matrix 3 and of the brush body holder 4 shall naturally be adapted to this shape.

Magazine 1 is located in such a manner above a table or the like, schematically shown as 5, that in this case an opening is left free on the two sides, which are parallel to the long axis of afore-mentioned ellipse, which is slightly larger than aforesaid long axis of the ellipse, and whereby these openings have a height which is just equal to or slightly greater than the thickness of brush bodies 2 concerned. A pushing plate 6 may be provided under this magazine 1, the front edge 7 of which is provided with a semi-elliptical cutaway part 8 which corresponds to the shape of the brush bodies 2. This plate is connected in an appropriate manner to a piston rod 9 of a pressure cylinder 10. Behind aforesaid magazine 1, a matrix 3 is provided, which, as is well known, consists of a lower plate 11, in which holes are provided at the appropriate locations, and an upper plate 12, fitted with punches 13 which can cooperate with the holes in lower plate 11. The brush body holder 4 is in this case made up of a bottom 14 and a lid 15, in both of which holes are provided which correspond to the holes in the lower plate 11 of the matrix 3. Whereas the bottom 14 is fixed, the lid 15 is provided to be able to rotate around a shaft 16, whereby the movement of lid 15 can for instance be controlled by a pressure cylinder 17, acting upon a protrusion 19 of lid 15, by means of a piston rod 18.

Figure 3:
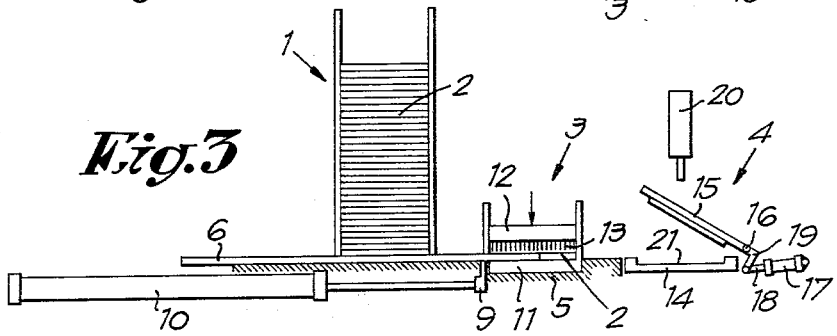
FIGS. 3 and 4 are similar views to that of FIG. 1, but for different positions of the device.
Figure 4:
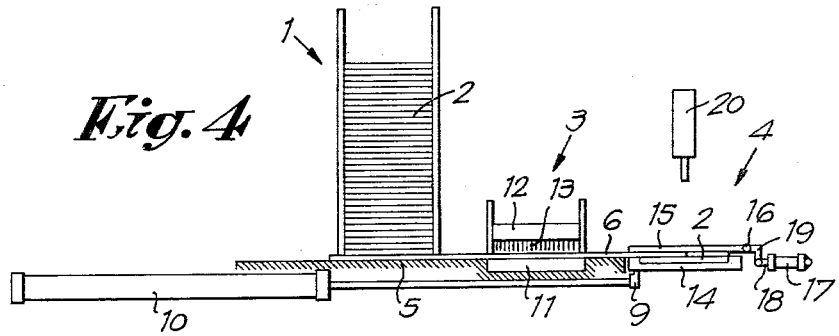

In FIGS. 1, 3 and 4, a filling device 20 is shown schematically above brush body holder 4, whereby it should be noted that this filling device may be fitted either in this location or in some other location, dependent upon the fact whether the brush body holder 4 is being moved or not.

Figure 2:
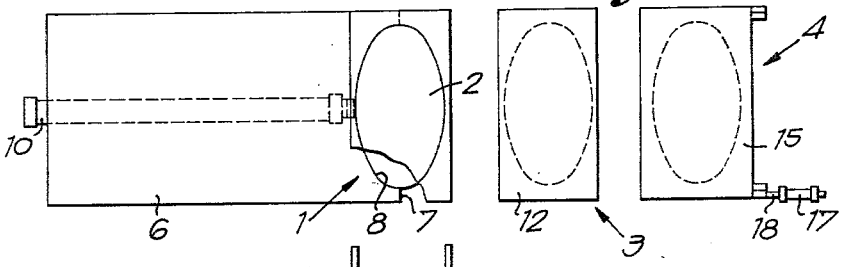
FIG. 2 shows a top view of FIG. 1.

In the position as shown in FIGS. 1 and 2, pushing plate 6 is in its rearmost position, or in other words, this pushing plate is located in such a manner that the bottom brush body 2 from magazine 1 fits in the cutaway 8 of pushing plate 6. The matrix 3 as well as the brush body holder 4 are in open position.

At this moment, pressure cylinder 10 will be operated, so that pushing plate 6 is moved to the position as illustrated in FIG. 3, so that one bottom brush body 2 is moved just into matrix 3, and such in a precisely determined location with respect to punch 13 and the corresponding holes in lower plate 11 of this matrix. At this moment, the upper plate 12 of the matrix 3 will be lowered in order to punch holes in the brush body concerned.

After matrix 3 has again been opened, pressure cylinder 10 shall be operated for a second time, whereby the brush body provided with holes will be moved out of matrix 3 and over table 5 into the brush body holder 4, or more particularly into the hollow 21 which is provided in bottom 14.

Next, by the appropriate operation of cylinder 17, lid 15 will be closed, whereas pushing plate 6 will simultaneously be retracted to its position of FIG. 1, in such a manner, that during the filling with fibres of the brush body located in brush body holder 4, by means of device 20, which may be operated in any appropriate manner and whereby either the brush body holder 4 or the filling device 20 will perform the required movements, another brush body 2 will be extracted from magazine 1 and brought into matrix 3.

It is quite obvious that in this manner a very simple device is obtained for the automatic handling of flexible brush bodies.

Figure 5:
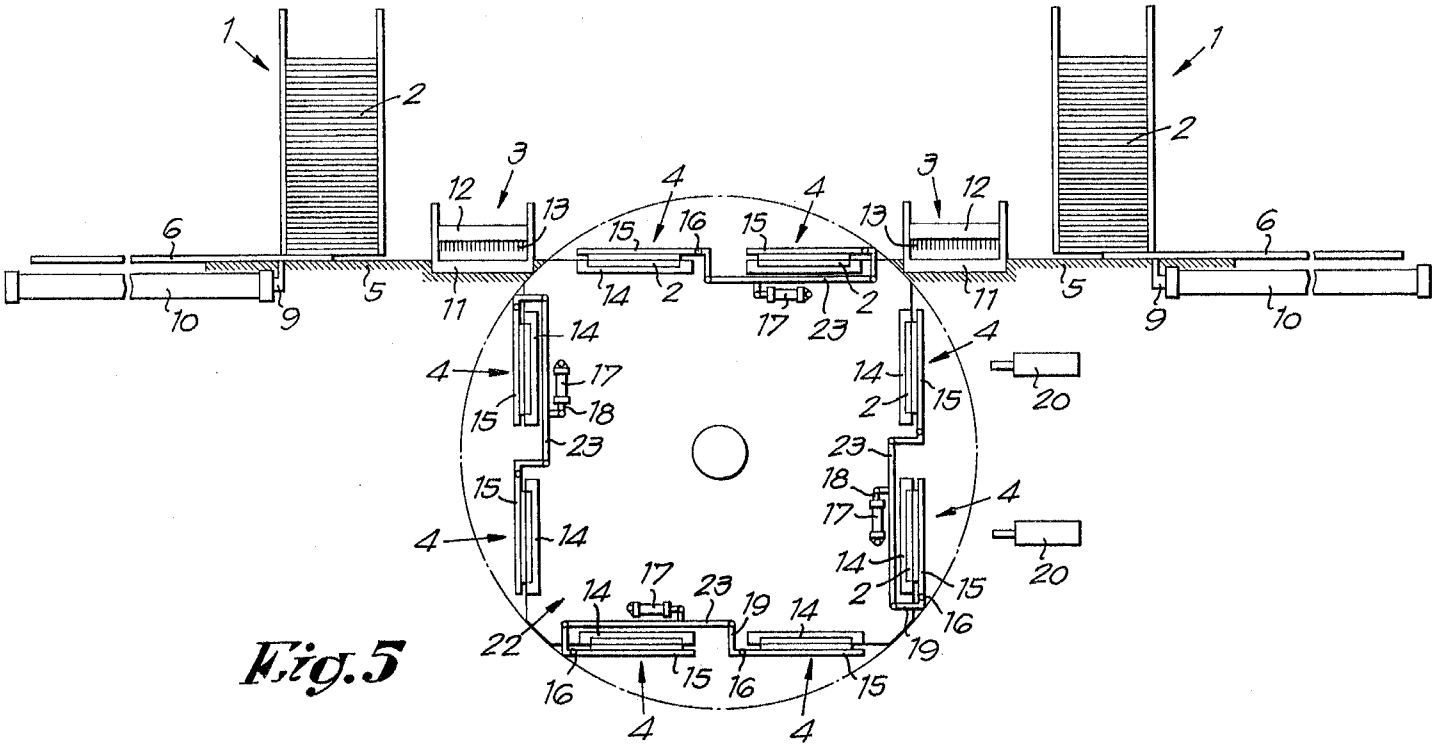
FIG. 5 shows a double device according to the invention applied to a so-called drum machine.
Figure 6:
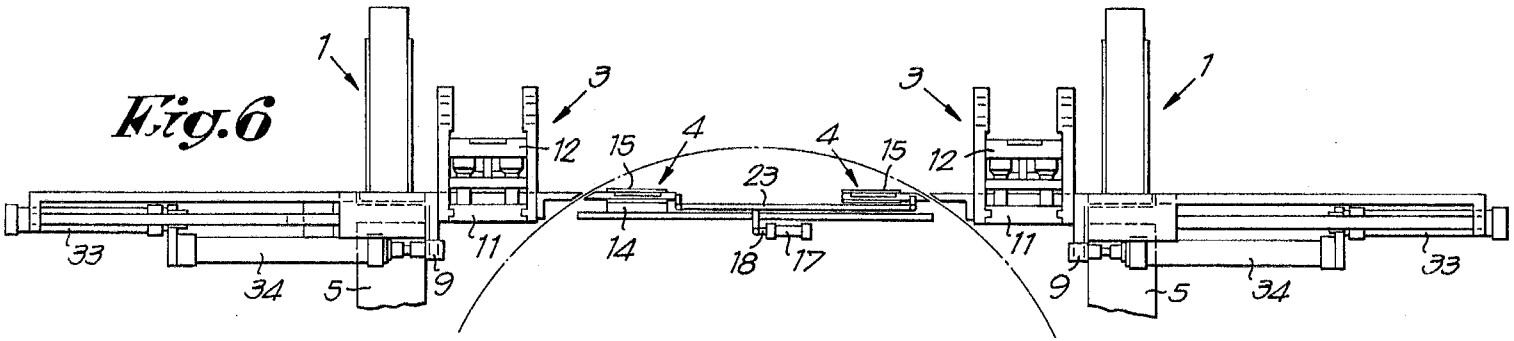
FIG. 6 shows the device of FIG. 5 in greater detail.
Figure 7:
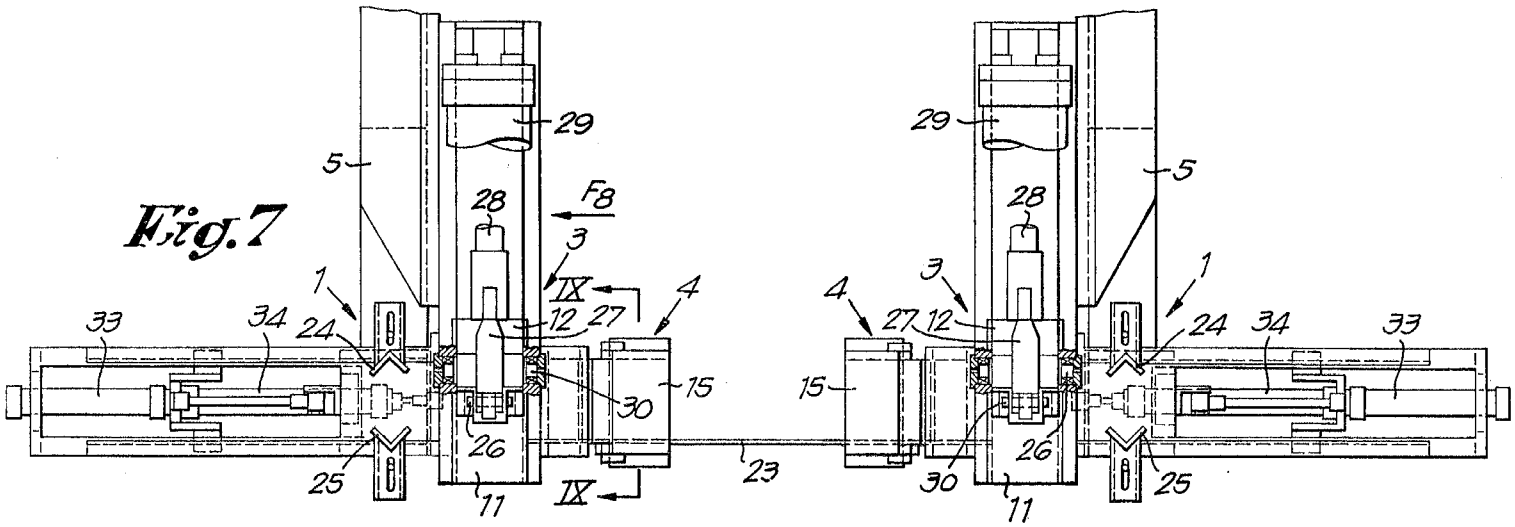
FIG. 7 shows a top view of FIG. 6.
Figure 8:
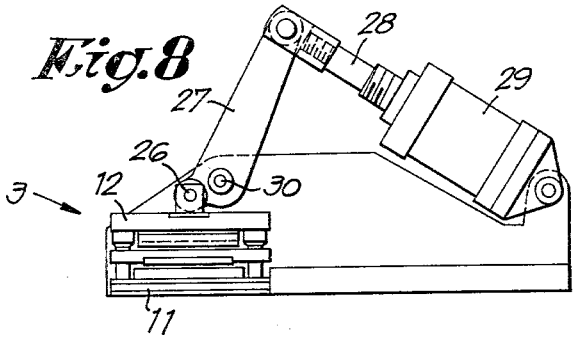
FIG. 8 is a view accordng to arrow F8 in FIG. 7.

In FIG. 5 an example is shown whereby two devices such as illustrated in FIG. 1 are coupled to a drum, schematically shown by 22, of a so-called drum machine.

In this case the device, as illustrated in FIG. 1, is duplicated and the brush body holders 4 are attached to a drum 22. The protrusions 19 of the two brush body holders 4 are hingedly linked together by means of a rod 23, to which in this case the piston rod 18 of a common pressure cylinder 17 is connected. The operation of this device is identically the same as described for the one according to FIG. 1.

In FIGS. 6 to 9, more details are given of a form of embodiment based on the one illustrated in FIG. 5.

Figure 9:
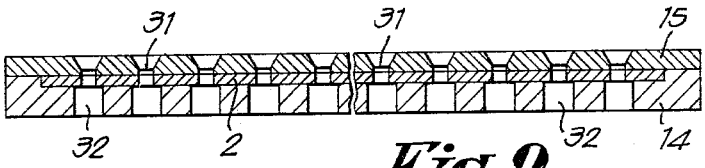
FIG. 9 shows a section, to a larger scale, according to line IX—IX in FIG. 7.

In this form of embodiment we again find the magazine 1, which in this case consists of at least two angle sections 24 and 25 which are adjustable with respect to each other; the matrix 3 of which the upper plate 12 is connected by means of a pivot 26 to a lever 27, whilch itself is hingedly connected to the piston rod 28 of a pressure cylinder 29, whereby the latter is hingedly attached to the framework of the machine, whereas lever 27 is also hingedly attached to aforesaid frame by means of a pivot pin 30; as well as the brush body holder 4 which, as can clearly be seen in FIG. 4, is made up of the bottom 14 and the lid 15 between which a brush body 2 can be entered and maintained, whereby small holes 31 and 32 are provided respectively in these parts 14 and 15. As can be seen in FIG. 9, the holes in lid 15 are made conical with a small cylindrical part for guiding the punch, whereas the holes in bottom 14 display a considerably larger diameter so as to permit the expansion of the fibres which are planted therein.

The operation of the device is practically the same as that previously described with respect to the schematic examples, with the difference however that in this form of embodiment pressure cylinder 10 is replaced by two pressure cylinders, respectively 33 and 34, whereby cylinder 33 provides for the movement of a brush body form magazine 1 to the matrix, whereas pressure cylinder 34 provides for the movement of this brush body from the matrix to the brush body holder. By means of this form of embodiment, the added advantage is obtained that the construction can be kept shorter.

Figure 10:
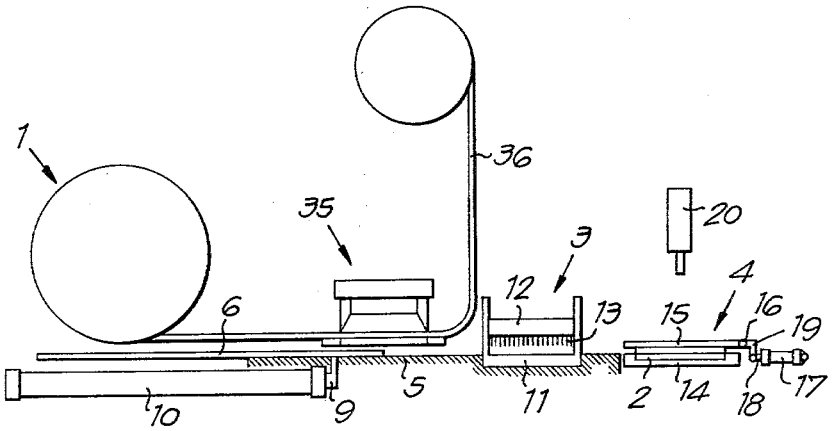
FIG. 10 shows a front view of an alternative form of embodiment according to the invention, whereby the brush bodies are punched directly out of a strip.

In FIG. 10 a further form of embodiment is schematically illustrated whereby, instead of the afore-mentioned magazine 1, a punching device 35 is provided, which each time appropriately punches out a brush body from a strip 36, which is subsequently moved towards matrix 3.

Figure 11:
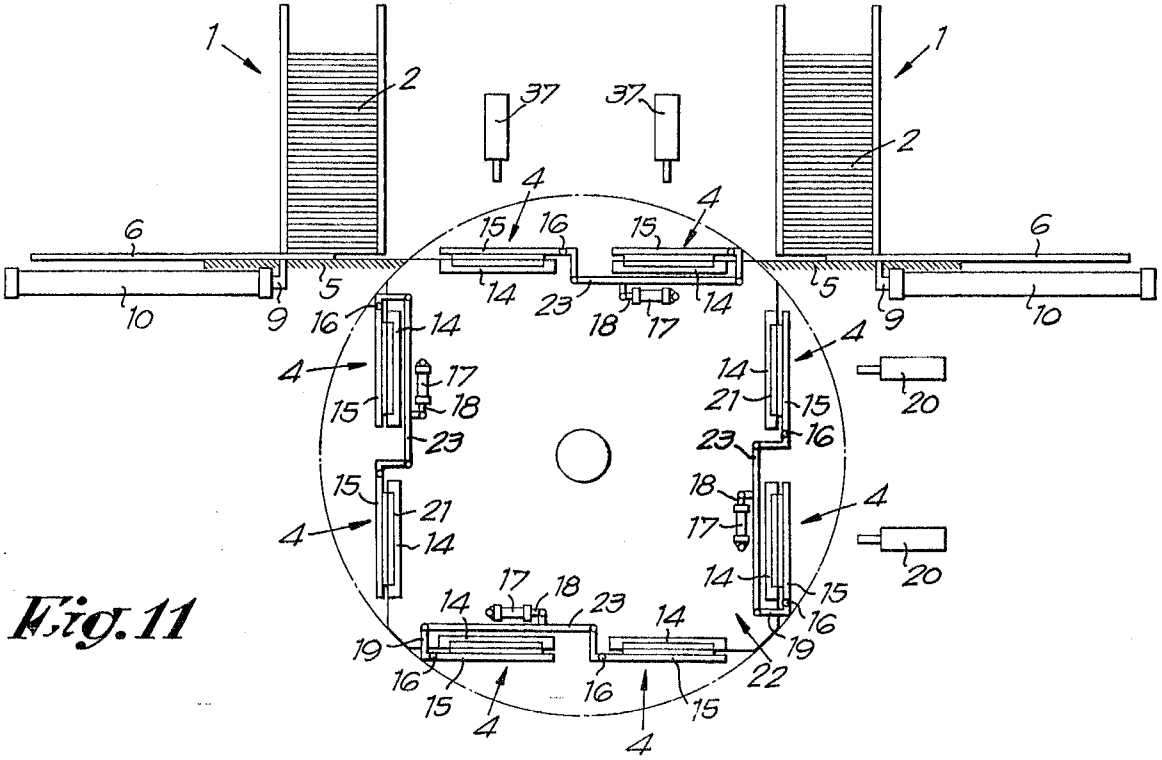
FIG. 11 shows a schematic view of yet another alternative form of embodiment.

Finally, in FIG. 11, a front view is schematically illustrated of an alternative form of embodiment of FIG. 5.

Hereby however, no matrix 3 is used, but the brush bodies are forwarded, for instance in the same manner as described with respect to FIG. 5, directly to the brush body holder 4, above which a punching unit 37 is fitted, which makes the required holes in the brush body, one at a time, after which drum 22 is rotated in such a manner that the brush bodies which have been provided with holes are brought under the filling devices 20.

It is quite obvious that the principle as described with respect to FIG. 11 can also be applied to so-called continuously operatng machines, which are not of the drum type.

For completeness' sake it must further be mentioned that, depending upon the material of which the flexible brush bodies are made, complementary devices can be provided, such as for instance for the automatic moistening of the flexible brush bodies; for the pressing of the brush bodies in the brush holders, before lid 15 is closed; etc.

The moistening can for instance be performed during the forwarding of the brush bodies, for instance by means of moistening rollers or by the means which press the brush body in the holder.

The afore-mentioned moistening with an appropriate liquid can indeed facilitate the planting of the fibres and consequently improve the aspect of the brush.

It is perfectly obvious that the present invention is by no means limited to the forms of embodiment described above merely as examples and illustrated in the appended drawings, but that such devices can be built in any shape or dimension and can be coupled to any type of machine for the fabrication of brushes, without going beyond the scope of the invention.

What I claim is:

1. A device for handling brush bodies of flexible material, including a supply station, a punching station, a filling station and feeding means for supplying brush bodies one at a time and for feeding each brush body from said supply station successively to said punching station and said filling station, said punching station including a pair of perforated first plates, first driving means to impart a relative movement to said first plates in order to clamp a brush body fed from said supply station therebetween and punching means for punching holes in the thus clamped brush body through said perforated first plates, and said filling station including a pair of perforated second plates, second driving means to impart a relative movement to said second plates in order to clamp a brush body fed from said punching station therebetween and filling means for inserting bristles into the punched holes of the thus clamped brush body through said perforated second plates.

2. A device accordng to claim 1, wherein each of said pairs of first and second plates comprises an upper plate and a lower plate havng a depression of the shape and size of said brush body.

3. A device accordng to claim 1, wherein said pair of second plates comprises a lower plate and an upper plate and means to pivot said upper plate with respect to said lower plate.

4. A device according to claim 1, wherein said feeding means are arranged below said stations and include a pusher plate having at its pusher end a cutaway portion the shape of which corresponds to the shape of a portion of the brush body to be pushed by said pusher plate.

5. A device according to claim 4, wherein said feeding means include two pressure cylinders and means to operate said two pressure cylinders in succession to bring a brush body from said supply station to said punching station and from said punching station to said filling station respectively.

6. A device according to claim 1 wherein said punching means comprise a matrix of punches.

7. A device according to claim 1 wherein said supply station includes a punching device for punching said brush bodies from a strip of material.

8. A machine according to claim 1 including an indexable drum for receiving brush bodies from said supply station.

* * * * *